US007506688B2

(12) United States Patent
Dávila

(10) Patent No.: US 7,506,688 B2
(45) Date of Patent: Mar. 24, 2009

(54) SYSTEM AND METHOD FOR BREACH DETECTION IN PETROLEUM WELLS

(75) Inventor: Vicente González Dávila, Cd. Madero (MX)

(73) Assignee: Geo Estratos, S.A.DE Cl.V., Cd. Madero, Tamaulipas (MX)

( * ) Notice: Subject to any disclaimer, the term of this patent is extended or adjusted under 35 U.S.C. 154(b) by 209 days.

(21) Appl. No.: 11/398,942

(22) Filed: Apr. 6, 2006

(65) Prior Publication Data

US 2007/0051511 A1 Mar. 8, 2007

(30) Foreign Application Priority Data

Sep. 7, 2005 (MX) ..... NL/A/2005/000067

(51) Int. Cl.
*E21B 47/00* (2006.01)

(52) U.S. Cl. ..... 166/250.08; 166/337

(58) Field of Classification Search ..... 166/337, 166/250.08; 73/49.5
See application file for complete search history.

(56) References Cited

U.S. PATENT DOCUMENTS

| | | | | | |
|---|---|---|---|---|---|
| 1,736,117 | A | | 11/1929 | Granger | |
| 1,889,889 | A | * | 12/1932 | Ennis | 324/325 |
| 2,210,417 | A | * | 8/1940 | Kinley | 73/40.5 A |
| 2,383,455 | A | * | 8/1945 | Abadie | 73/152.13 |
| 2,540,049 | A | * | 1/1951 | Hinson | 250/260 |
| 3,165,919 | A | | 1/1965 | Loomis | |
| 3,194,310 | A | | 7/1965 | Loomis | |
| 3,776,032 | A | | 12/1973 | Vogel | |
| 4,101,827 | A | | 7/1978 | Offner | |
| 4,114,721 | A | | 9/1978 | Glenn, Jr. | |
| 5,123,487 | A | | 6/1992 | Harris et al. | |
| 5,127,473 | A | | 7/1992 | Harris et al. | |
| 5,267,469 | A | * | 12/1993 | Espinoza | 73/40.5 R |
| 5,548,530 | A | | 8/1996 | Baumoel | |

(Continued)

*Primary Examiner*—David J Bagnell
*Assistant Examiner*—Cathleen R Hutchins
(74) *Attorney, Agent, or Firm*—Gunn, Lee & Cave, P.C.

(57) ABSTRACT

The present invention includes a method and system for detecting and locating a breach of a pipe in nested multi-pipe petroleum wells through the use and measurement of pressure valves and pressure sensors. The system "locates" breaches in the sense that it determines in which pipe or pipes, if any, in a nested multi-pipe production well the breach exists. The method comprises the steps of, first, connecting at least two of the well pipes of a nested multi-pipe production well to a collection reservoir to allow fluid communication from the well into the reservoir; second, sealing the well pipes to maintain the pressure therein; third, measuring a pressure parameter within each of said at least two well pipes until said pressure parameter indicates a stabilization of pressure therein; fourth, altering the pressure within one of the well pipes; fifth, measuring a pressure parameter within the other well pipes; and sixth, stabilizing the pressure in the well pipe within which the pressure was previously altered.

According to one aspect of the invention, a system controller executes a predefined program, which detects breaches between pipes comprising the production well by selectively altering pressure into the pipes and measuring the pressure change within the remaining well pipes. A change in the pressure indicates that the well pressure has escaped the well pipe through a breach therein. In this manner, the presence and location of breaches can be detected, and appropriate repair steps undertaken, before substantial contamination of the environment occurs.

24 Claims, 3 Drawing Sheets

U.S. PATENT DOCUMENTS 6,442,999 B1 9/2002 Baumoel
6,489,894 B2 * 12/2002 Berg ..... 340/605
6,499,540 B2 * 12/2002 Schubert et al. ..... 166/337
6,513,591 B1 * 2/2003 Heijnen ..... 166/250.08
6,530,263 B1 3/2003 Chana et al.
6,595,038 B2 7/2003 Williams et al.
6,668,619 B2 12/2003 Yang et al.
6,802,375 B2 10/2004 Bosma et al.
6,978,661 B2 * 12/2005 Hutchinson et al. ..... 73/49.2
2004/0261504 A1 * 12/2004 Hutchinson et al. ..... 73/49.2

* cited by examiner

SYSTEM AND METHOD FOR BREACH DETECTION IN PETROLEUM WELLS

This is a non-provisional application relating to the content of, and claiming priority to, Mexican Patent Application No. NL/a/2005/000067, filed Sep. 7, 2005, which is incorporated by reference herein.

BACKGROUND OF THE INVENTION

1. Field of the Invention

The invention relates to the field of crude oil production and, more specifically, to a system and method for detecting and locating a breach of a pipe in a nested multi-pipe petroleum well through the use and measurements of pressure sensors and pressure valves. The phrases "petroleum well," "production well," "hydrocarbon well," and "oil well" are used synonymously throughout this application, and includes the production of petroleum in both liquid and gaseous form.

2. Background Information

A typical hydrocarbon production well is comprised of a production pipe nested within one or more casing pipes, all of which are generally concentrically aligned. These typical hydrocarbon wells emanate a natural well pressure that is different from atmospheric pressure, which well operators use, inter alia, to remove the hydrocarbon fluids and gases from within the well. This natural well pressure can be generated over a large volume of the formation, and will try to escape by the path of least resistance to the surface. Thus, the natural well pressure may naturally flow into the well pipes of the hydrocarbon well. This pressure may then be used to detect a breach between two well pipes of a nested multi-pipe production well, as described herein.

While the production pipe communicates hydrocarbons to the surface, surrounding casing pipes primarily serve to reinforce the main borehole. The casing pipes are usually cemented into place, although the annulus 26 between the production pipe and the innermost casing pipe may instead be sealed from the hydrocarbon producing zone with a packer, which is a common downhole tool used to isolate a production well annulus 26 from hydrocarbon liquids and gases.

Generally, the production pipe and casing pipes are made of steel, which is susceptible to oxidation and corrosion over time that may cause the oil well to leak hydrocarbon fluid or gases through the casing pipes and into the surrounding earth. These leaked hydrocarbons may eventually surface at ground level and, as they move through the earth, cause a harmful environmental impact to surface and underground water and soil, as well as wildlife, during migration to the surface. Such leaking might also cause an unsightly accumulation of crude oil at the surface.

Numerous United States patents address the detection of leaks within production wells. For example, U.S. Pat. No. 3,776,032 discloses a method of protecting a well from an inflow of either gas or liquid. The detection process involves the use of pressure mud pulses from a pair of acoustical transducers, which generate signals in the form of pressure waves, both before the drilling mud is circulated to the drill bit and after drilling mud is circulated through the drill bit. The difference, if any, between the two pulses is then converted to a signal and transmitted to the surface.

U.S. Pat. No. 4,114,721 discloses a pair of acoustic detectors moving through a well to detect sound indicative of a casing leak. As hydrocarbon fluids or gases move through a breach in the casing, the acoustic noise is monitored at two locations within the borehole. The signals from the monitors are transmitted to the surface and used to determine the location of the breach.

U.S. Pat. No. 4,101,827 discloses a method of detecting leaks in an underground pipe that is made of an insulator. The process involves partially filling the pipe with an electrically-conductive fluid (such as tap water), passing an electrical current through the fluid to establish a voltage gradient along the length of the fluid in the pipe, then analyzing the resulting gradient to determine the location of the leak. The voltage source is connected to a first electrode, which is immersed in the liquid at one pipe end, and to a second electrode, which is driven into the ground. This method involves inserting a wire inside the underground pipe in order to properly determine the potential drop across the gradient. The well operator determines the location of the leak by measuring the length of wire inserted into the underground pipe at the location of the potential drop—i.e., the point of minimal voltage.

U.S. Pat. No. 5,548,530 discloses a non-intrusive high-precision ultra-sonic leak detection system for pipelines used to identify development of even very minute leaks. The system locates these leaks to within several meters of their actual location in a segment of the pipeline between two site stations of the leak detection system. Leaks are located and their locations determined by their effect on the pressure of the pipeline and the effect of the pressure change on liquid density. U.S. Pat. No. 6,442,999 includes a master station to which these site stations transmit sonic wave data in order to perform calculations to determine the presence of a leak and its location.

U.S. Pat. No. 6,530,263 discloses a system for locating leaks in a pipeline using loggers that are positioned along the pipeline at spaced intervals. These loggers detect and store sound data produced within the pipeline and download the stored sound data to a computer system for analysis. The location of leaks is derived from this analysis.

U.S. Pat. No. 6,595,038 discloses an apparatus for determining the position of a leak in an underground pipe for fluid or gas using acoustic sensors. A first sensor is coupled to the pipe while a second sensor is movable above the pipe. Both sensors detect sound either carried along the walls of the pipe or along fluid in the pipe. Based on the sound reading, the location of the leak can be determined.

U.S. Pat. No. 6,668,619 discloses a method and apparatus for locating the source of a leak in a pipeline using match pattern filtering techniques. These match pattern filters discriminate against background noise and pressure disturbances generated by other, non-leak sources. This method uses acoustic signals to determine whether a leak exists and where it is located.

U.S. Pat. No. 6,650,125 discloses locating leaks of conductive fluids, such as ionized water, from non-conductive structures, such as pipes, through the use of a charge generator. The generator charges and discharges the conductive fluid, and a capacitive-type portable detector detects the variable charge that is induced in the fluid.

While the prior art discloses several complex methods for detecting breaches in piping, the current art does not disclose a method of detecting breaches in a nested multi-pipe hydrocarbon production well that is simple, inexpensive, and accurate. Furthermore, the prior art discloses methods of breach detection that require disposing tools and equipment down the wellbore, which complicates the breach-detection process. A need therefore exists for a cost-efficient and simple system and method for locating crude oil leaks in these nested multi-pipe production wells.

SUMMARY OF THE INVENTION

The present invention provides for a system and method to detect and locate breaches in nested multi-pipe oil wells quickly and efficiently while minimizing or eliminating the adverse effects resulting from hydrocarbon contamination. The method identifies breaches in the production and casing pipes, collectively referred to herein as "well pipes," in order to provide an efficient means of preempting development of hazardous environmental problems from deteriorating steel. "Locating" breaches, as used herein, refers to determining in which well pipe of a nested multi-pipe production well, if any, a breach exists.

The present invention discloses, inter alia, a method of detecting a breach between well pipes of a nested multi-pipe production well that is comprised of a production pipe, through which hydrocarbons flow, and at least one casing pipe, which surrounds the production pipe and reinforces the borehole of the well. There may be many casing pipes, each nested within the casing pipe of the next larger diameter. A multi-pipe production well includes a well with one production pipe and one casing pipe and a well with one production pipe and multiple casing pipes.

Generally, the annulus between the first (or innermost) casing pipe and the production pipe is unfilled, but sealed from the hydrocarbon production zone with a packer, which is a common downhole tool used for this purpose. The packer isolates the annulus of a hydrocarbon well against the pressure and flow of gases and liquids from the hydrocarbon production zone. The remaining casing pipes are typically filled with cement to provide added structural stability. These well pipes, meaning collectively both the production pipe and any casing pipes, extend from the production zone through the surface and are attached to a valve tree, which allows the well pipes to be broken-out from their nested configuration and redirected to various locations above the surface.

As used in a typical nested multi-pipe hydrocarbon well, the method of the present invention comprises the steps of connecting at least two of the well pipes of a nested multi-pipe production well to a collection reservoir to allow fluid communication from the well into the reservoir; sealing the well pipes to maintain the pressure therein; altering the pressure within one of the well pipes; measuring a pressure parameter within the other well pipes; and stabilizing the pressure in the well pipe within which the pressure was previously altered. Furthermore, the altering, measuring, and stabilizing steps can be applied specifically with reference to each of the well pipes that comprise the well, meaning that the pressure within each well pipe can be altered, a pressure parameter from the other pipes measured, and then the pressure stabilized. Although the preferred sequence is to start with the innermost well pipe—the production pipe—and sequentially apply these steps to each of the well pipes in a progressively outward sequence, the method could be applied to the well pipes in a different order.

Although the method can be manually applied, the method is most efficiently performed automatically rather than manually. Thus, another aspect of the method involves a system controller performing the sealing, altering, measuring, and stabilizing steps of the method. The system controller is a computer configured for actuating pressure valves and receiving the pressure parameter readings from the pressure sensors.

According to one aspect of the method, the step of connecting the well pipes to a collection reservoir is accomplished by attaching at least two discharge pipes to the well pipes, one discharge pipe being connected between each well pipe and the collection reservoir. The discharge pipes allow hydrocarbon fluids to flow into and be collected by the collection reservoir, which is typically embodied as a portable metal container. This outflow of fluid occurs when the natural well pressure is allowed to freely flow from the production pipe. Sometimes hydrocarbon fluids will also flow from the casing pipes, depending on, for example, whether there is a breach between a casing pipe and the production pipe or whether a packer otherwise sealing the annulus between these well pipes has ruptured. The collection reservoir receives this residual hydrocarbon fluid from the well pipes to, inter alia, prevent contamination of the surrounding earth.

Furthermore, according to another aspect of the method, pressure valves and pressure sensors are interposed between the well pipes and the collection reservoir to control pressure communication therebetween and to monitor the pressure within the well pipes during application of the breach detection method. When in a closed configuration, a pressure valve will prevent pressure communication therethrough; when in an opened configuration, a pressure valves allow pressure communication therethrough. Because the method requires the measurement of a pressure parameter within the well pipes when they are sealed, the pressure sensors are positioned between the well pipes and the pressure valves. The pressure sensors monitor and indicate a pressure parameter from within the well pipes to which they are attached. If the pressure valves and pressure sensors are first interposed between the ends of the discharge pipes prior to attaching the discharge pipes between the well pipes and the collection reservoir, the sub-step of interposing pressure valves and pressure sensors occurs contemporaneously with the attached sub-step of the method.

According to another aspect of the method, the sealing step is further comprised of the step of preventing fluid or pressure communication between the well pipes and the collection reservoir. This may be accomplished, for example, by moving interposed pressure valves to the closed position.

According to another aspect of the method, after sealing the well pipes, the well operator (or the system controller, as later described herein, when the method is automatically performed) measures a pressure parameter within all the well pipes until the pressure parameter within all of the well pipes is constant, which means that the pressure within the well pipes is at equilibrium. Pressure within one of the well pipes is then altered. Pressure parameters are then measured from the remaining pipes, and these pressure parameters are then compared against the previously measured parameters. The well operator (or system controller) then interprets a change in pressure parameters from the prior measurements as a breach in the well pipe in which the pressure was altered.

Because hydrocarbon production wells emanate a natural well pressure different from atmospheric pressure, another aspect of the method involves using the natural well pressure for the breach detection method. According to another aspect of the present invention, the altering step further comprises the step of opening a pressure valve interposed between the well pipe within which the pressure is to be altered and the collection reservoir. By opening the pressure valve, the pressure within the pipe, which is at least partly caused by the communication of natural well pressure into the well pipe, changes because the pressure is communicated through and out of a discharge pipe. The pressure change within the pipe will be communicated to one or more of the other well pipes if breaches are present therebetween. In this manner, a breach can be detected by comparing pressure parameters measured before and after the pressure within a well pipe is altered to determine if pressure has been communicated through a breach in a casing pipe into which the pressure was communicated.

According to another aspect of the present invention, the stabilizing step further comprises the step of closing the previously-opened pressure valve. By closing the previously-opened pressure valve, the pressure within the well pipes will again stabilize and provide a reference point against which future pressure changes can be compared.

The measured pressure parameter within the production or casing pipes may be the pressure within the pipes, the rate of change of pressure within the pipes, or any other measurement that can reliably indicate a breach in a pipe.

The present invention also discloses a breach detection system for use in a nested multi-pipe production well. The system is comprised of at least two discharge pipes, a collection reservoir, at least two pressure valves, and at least two pressure sensors. Each of the discharge pipes is attached to either the production pipe or one of the casing pipes (collectively referred to as the well pipes) of the production well and, at the other end of each of the discharge pipes, to the collection reservoir. Attachment of the well pipes to the collection reservoir need only be sufficient to allow fluid communication from the discharge pipe into the collection reservoir. The pressure valves are interposed between the well pipes and the collection reservoir, and are used to selectively prevent or allow pressure communication from the well pipes. Each of the pressure valves prevents pressure communication when in a closed configuration and allows pressure communication when in an opened configuration. Each pressure sensor measures a pressure parameter within the well pipe to which it is operably attached.

According to another aspect of the present invention, the breach detection system further comprises a system controller that is operably attached to one or more of the pressure sensors and pressure valves. The system controller then actuates the operably-connected pressure valves and receives data from the operably-connected pressure sensors according to a predefined program, which may embody the breach detection method of the present invention herein described. According to another aspect of the system, the system controller also generates output that indicates which pipes, if any, of the nested multi-pipe production well are breached. In this sense, "locating" a breach means determining within which well pipe of a nested multi-pipe hydrocarbon well, if any, a breach exists. Furthermore, and according to another aspect of the present invention, the system controller accepts user input and optionally actuates one or more pressure valves of the breach detection system according to the user input and generates output indicating the presence and location of any breaches based on pressure parameters measured by the pressure sensors and communicated to the system controller.

BRIEF DESCRIPTION OF THE DRAWINGS

The present invention, as well as further objects and features thereof, are more clearly and fully set forth in the following description of the preferred embodiment, which should be read with reference to the accompanying drawings, wherein.

DESCRIPTION OF THE PREFERRED EMBODIMENT

Figure 1:
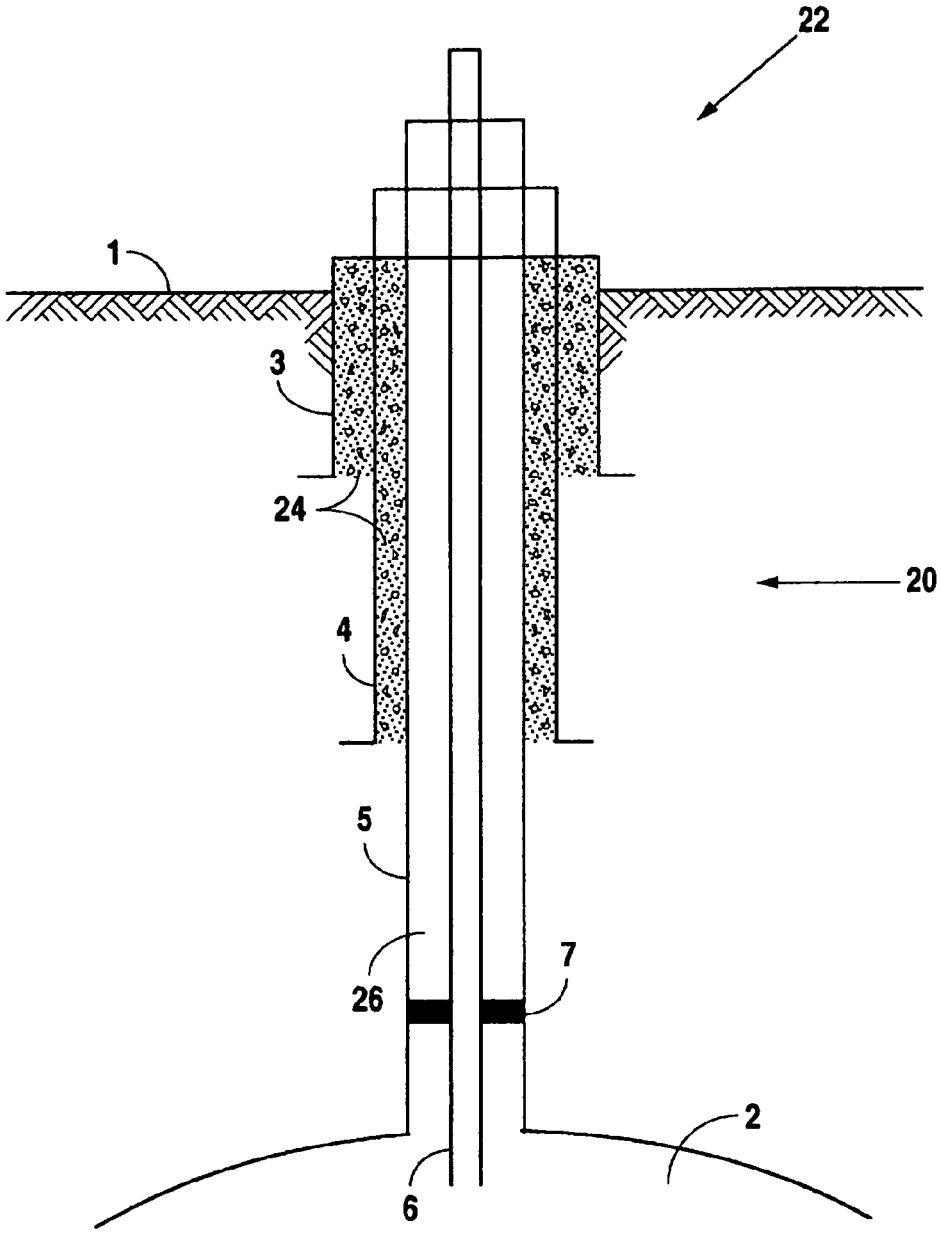
Fig. 1 (PRIOR ART)
FIG. 1 shows a sectional view of a typical nested multi-pipe hydrocarbon production well, which is prior art.

FIG. 1 shows a sectional view of a typical nested multi-pipe hydrocarbon production well 20, which is known in the prior art. The production well 20 is drilled into a ground surface 1 and is comprised of nested well pipes 22 used in combination to produce hydrocarbons. The well pipes 22 are further comprised of a production pipe 6 and a plurality of casing pipes 3 through 5. The production pipe 6 spans from above the ground surface 1 through the earth to a hydrocarbon deposit zone 2, from which hydrocarbon fluids and gas are removed to the surface. A first casing pipe 5 encloses the production pipe 6, and the annular space between the first casing pipe 5 and the production pipe 6 is sealed from the hydrocarbon deposit zone 2 by a packer 7. The first casing pipe 5 is nested within a second casing pipe 4, which in turn is nested within a third casing pipe 3. Cement 24 fills the annulus between the two outermost casing pipes 3, 4 to hold them in place. Although FIG. 1 shows only three casing pipes 3 through 5, a typical multi-pipe production well can have more or less of these casing pipes. Similarly, the casing pipes 3 through 5 might not be reinforced with cementious or other reinforcing material. Each of the well pipes 22 is attached to a valve tree (not shown in FIG. 1) through which each casing pipe 3 through 5 and the production pipe 6 within the nested multi-pipe production well 20 can be accessed at the ground surface 1.

Figure 2:
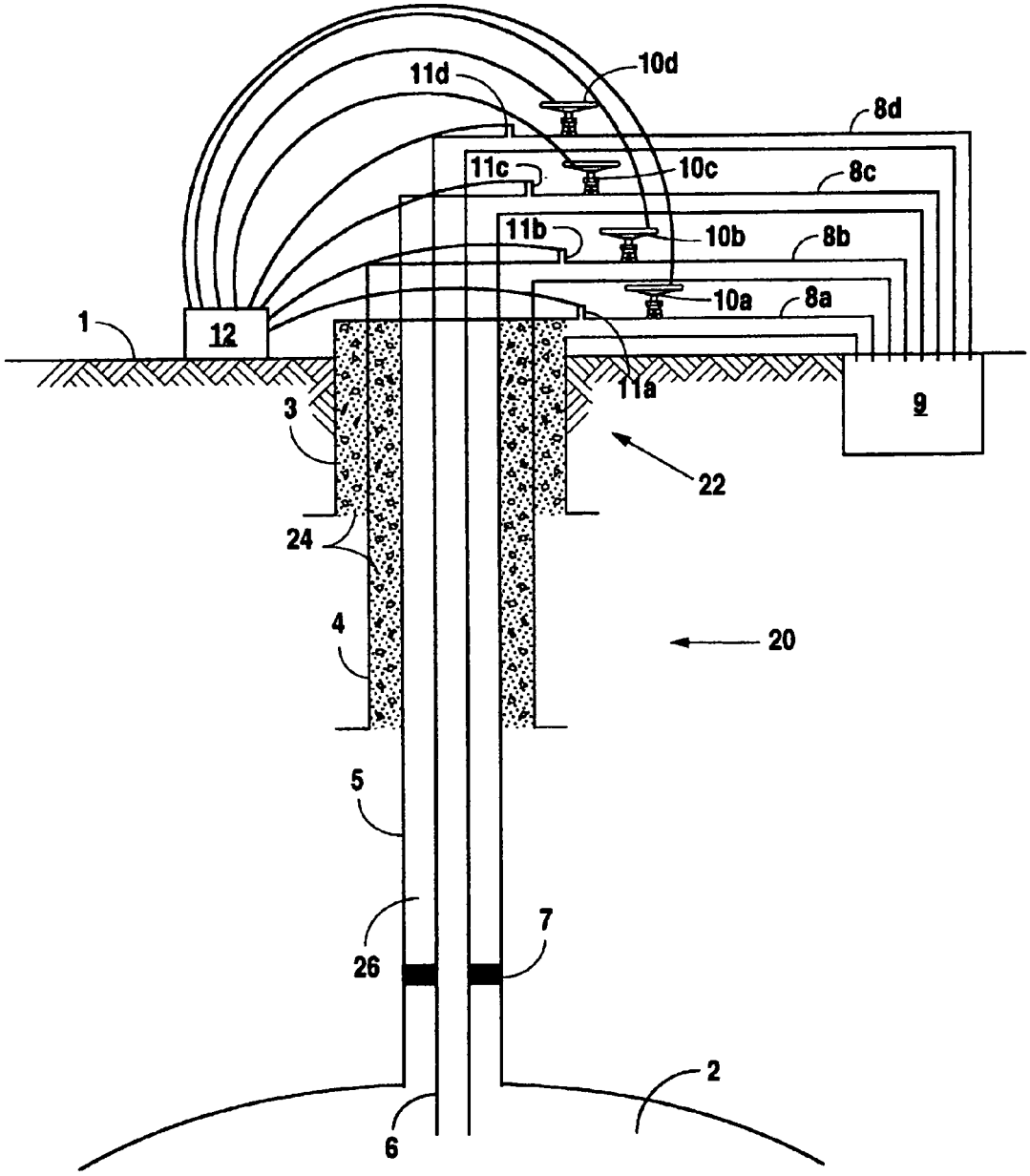
FIG. 2 shows a sectional view of the disclosed breach detection system installed in the nested multi-pipe hydrocarbon well of FIG. 1.

FIG. 2 shows the preferred embodiment of the present invention, a breach-detection system for use in a nested multi-pipe hydrocarbon well. Discharge pipes 8*a* through 8*d* connect the well pipes 22 of the typical multi-pipe hydrocarbon well 20 shown in FIG. 1 to a collection reservoir 9. The discharge pipes 8*a* through 8*d* are attached to the well pipes 22 in such a manner so as to seal each of the well pipes 22 from the entry or escape of gas and liquid at the junction between the well pipes 22 and the discharge pipes 8*a* through 8*d*. The attachment of the discharge pipes 8*a* through 8*d* to the collection reservoir need only be sufficient to allow hydrocarbon outflow from the pipes to enter the collection reservoir 9 and remain contained thereby.

Interposed between the ends of each of the discharge pipes 8*a* through 8*d* are pressure valves 10*a* through 10*d* for preventing the flow of liquids and gases through the discharge pipes 8*a* through 8*d* and into the collection reservoir 9. When closed, the pressure valves 10*a* through 10*d* prevent fluid or pressure communication from the well pipes 22 to the collection reservoir 9. Pressure sensors 11*a* through 11*d*, which are interposed between the well pipes 3 through 6 and the pressure valves 10*a* through 10*d* measure and indicate the pressure within the well pipes 22.

As further shown in FIG. 2, a system controller 12 is operably connected to each of the pressure sensors 11*a* through 11*d* in such a manner so as to allow the system controller 12 to selectively receive a measured pressure parameter from the pressure sensors 11*a* through 11*d*. Similarly, the system controller 12 is connected to each of the pressure valves 10*a* through 10*d* in such a manner so as to allow the system controller 12 to selectively open or close each of pressure valves 10*a* through 10*d*. In the preferred embodiment, the system controller 12 is operably connected to both open and close the pressure valves 10*a* through 10*d* and monitors the pressure sensors 11*a* through 11*d* according to a predefined program.

Figure 3:
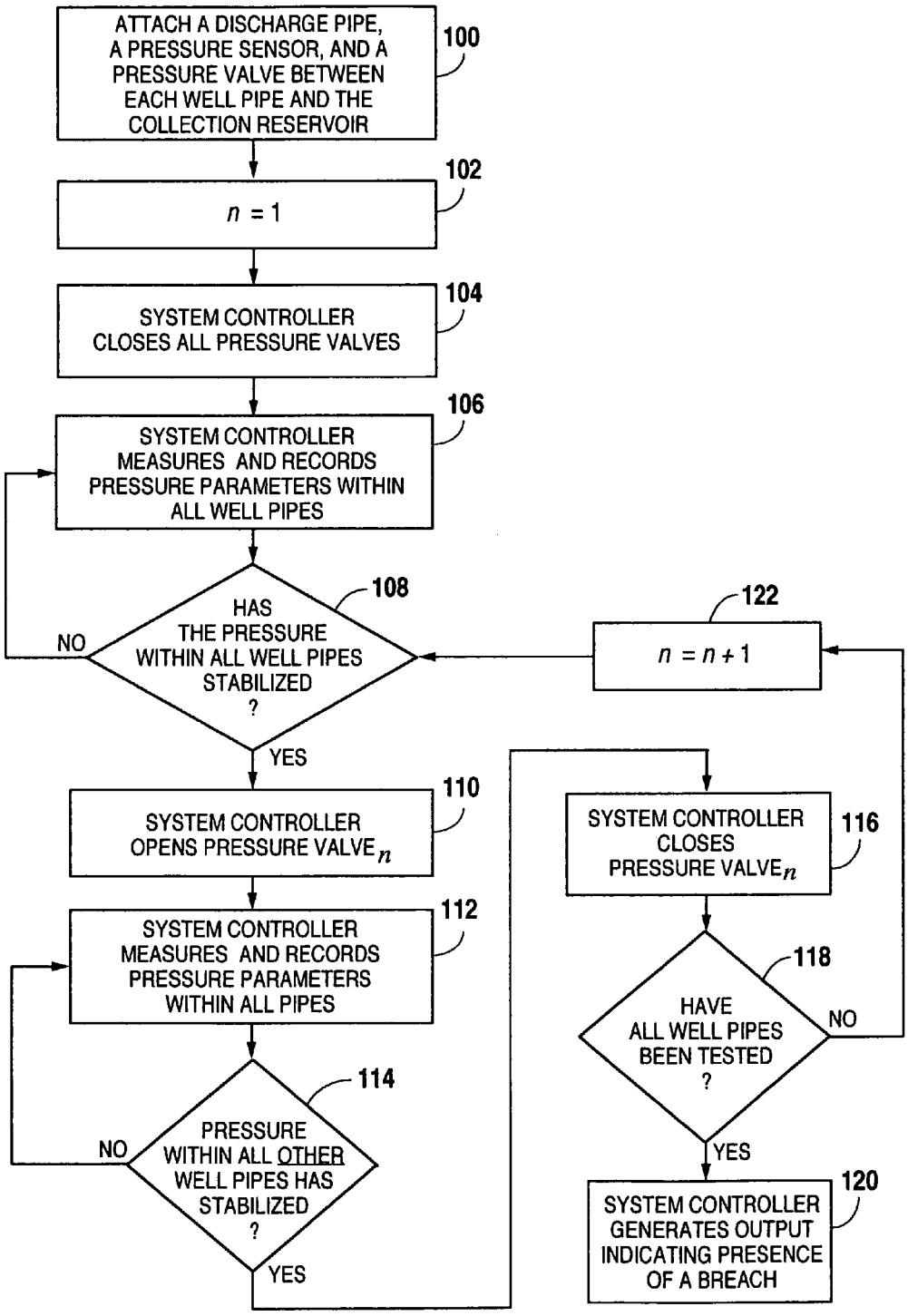
FIG. 3 shows a block diagram of a method of detecting a breach between well pipes of a nested multi-pipe hydrocarbon well.

FIG. 3 graphically illustrates, by way of block diagram, the preferred application of the breach detection method for the nested multi-pipe production well with n well pipes where the method is automatically performed by a system controller, and where pressure valve$_n$ represents the pressure valve interposed between well pipe$_n$ and a collection reservoir to prevent or allow pressure communication therethrough. Application of the method begins by first attaching 100 each of a discharge pipe, a pressure sensor and a pressure valve between each well pipe of a nested multi-pipe well and the collection reservoir. As previously described herein, the pressure sensors must be positions on the "well pipe"-side of the pressure valve so a pressure parameter within the well pipes can be measured when the pressure valves are in a closed configuration. This application of the breach detection method of the present invention begins by altering the pressure within the innermost well pipe 102, for which n=1. After the initial attaching step 100, the system controller seals 102 the well pipes to maintain the pressure within those pipes. Subsequently, the system controller measures and records 106 pressure parameters from within every well pipe and waits until the pressure within all pipes has stabilized 108. Beginning with the innermost pipe (where n=1), which is a production pipe, the system controller next opens 110 the pressure valve operably attached thereto, which releases the pressure within the well pipe through the attached discharge tube, thereby altering the pressure within well pipe$_n$. The system controller next measures and records 112 a pressure from within all the well pipes until the pressure parameter within all pipes as stabilized 114, and then closes the pressure valve 116. If the system controller determines 118 that not all pipes have been tested, the system controller proceeds to the next pipe 122 and repeats the steps for each of the well pipes of the hydrocarbon well. After the system controller determines that all of the well pipes have been tested 118, the system controller generates the output indicating the results of the breach detection method 120.

The present invention is described in terms of a preferred illustrative embodiment in which a specifically described nested multi-pipe hydrocarbon production well and breach detection system are described. Those skilled in the art will recognize that alternative embodiments of breach detection system, and alternative applications of the breach detection method, can be used in carrying out the present invention.

Furthermore, the present invention is not limited to use only in nested multi-production wells with a predetermined number of casing pipes, production pipes, or other pipes. The system and method is equally applicable for breach detection regardless of the number of casing and production pipes.

Other aspects and advantages of the present invention may be obtained from a study of this disclosure and the drawings, along with the appended claims.

I claim:

1. A method of locating pressure communication through a breach in an interior pipe of a nested multi-pipe production well wherein the vertical position of the breach is radially encompassed by the next outermost pipe, said method comprising the steps of:

first, connecting at least two well pipes of a nested multi-pipe production well to a collection reservoir to allow fluid communication thereto;

second, sealing said at least two well pipes to maintain pressure therein;

third, measuring a pressure parameter within each of said at least two well pipes until said pressure parameter indicates a stabilization of pressure therein;

fourth, altering the pressure within one of said at least two well pipes;

fifth, measuring an internal pressure parameter within each of the remainder of said at least two well pipes; and sixth, stabilizing the pressure within said one of said at least two well pipes.

2. A method of locating pressure communication through a breach in a nested multi-pipe production well, as recited in claim 1, wherein:

said step of measuring a pressure parameter within each of said at least two well pipes is repeated until said internal pressure parameter stabilizes; and said step of measuring an internal pressure parameter within each of the remainder of said at least two well pipes is repeated until said internal pressure parameter stabilizes.

3. A method of locating pressure communication through a breach a nested multi-pipe production well, as recited in claim 2, wherein said connecting step further comprises the step of attaching at least two discharge pipes between said at least two well pipes and said collection reservoir, there being one discharge pipe attached between each of said at least two well pipes and said collection reservoir, the attachment being sufficient to prevent entry or exit of fluids at an attachment point of said at least two well pipes.

4. A method of locating pressure communication through a breach in a nested multi-pipe production well, as recited in claim 3, wherein said connecting step further comprises the steps of:

interposing at least two pressure valves between said at least two well pipes and said collection reservoir, said at least two pressure valves preventing pressure communication through said at least two discharge pipes when said at least two pressure valves are in a closed configuration, and said at least two pressure valves allowing pressure communication through said at least two discharge pipes when said at least two pressure valves are in an opened configuration, each pressure valve being separately configurable; and interposing at least two pressure sensors between said at least two well pipes and said at least two pressure valves, there being one of said at least two pressure sensors interposed between each of said at least two well pipes and each of said at least to pressure valves.

5. A method of locating pressure communication through a breach in a nested multi-pipe production well, as recited in claim 4, wherein said sealing step further comprises the step of preventing fluid or pressure communication between said at least two well pipes and said collection reservoir.

6. A method of locating pressure communication through a breach in a nested multi-pipe production well, as recited in claim 5, wherein said preventing step further comprises the step of closing said at least two pressure valves.

7. A method of locating pressure communication through a breach in a nested multi-pipe production well, as recited in claim 6, wherein said altering step further comprises the step of opening one of said at least two pressure valves.

8. A method of locating pressure communication through a breach a nested multi-pipe production well, as recited in claim 7, wherein said sixth step further comprises the step of closing said one of said at least two said pressure valves.

9. A method of locating pressure communication through a breach in a nested multi-pipe production well, as recited in claim 8, wherein said internal pressure parameter within each of the remainder of said at least two well pipes is the rate of change of the pressure.

10. A method of locating pressure communication through a breach in between well pipes of a nested multi-pipe production well, as recited in claim 8, wherein said internal pressure parameter within each of the remainder of said at least two well pipes is the pressure.

11. A method of locating pressure communication through a breach in between pipes of a nested multi-pipe production well, as recited in claim 10, wherein said third, fourth, fifth, and sixth steps are performed by a system controller.

12. A method of locating pressure communication through a breach in between pipes of a nested multi-pipe production well, as recited in claim 11, wherein said measuring steps are continuously performed by a system controller.

13. A method of locating pressure communication through a breach in a portion of a pipe in a nested multi-pipe production well when the natural pressure exteriorly adjacent said breach is higher than the pressure within said pipe, said pipe portion not being radially encompassed by another pipe, and said method comprising the steps of:

first, connecting at least two well pipes of a nested multi-pipe production well to a collection reservoir to allow fluid communication thereto;

second, sealing said at least two well pipes to maintain pressure therein;

third, measuring a pressure parameter within each of said at least two well pipes until said pressure parameter indicates a stabilization of pressure therein;

fourth, altering the pressure within one of said at least two well pipes;

fifth, measuring an internal pressure parameter within each of the remainder of said at least two well pipes; and sixth, stabilizing the pressure within said one of said at least two well pipes.

14. A method of locating pressure communication through a breach in a nested multi-pipe production well, as recited in claim 13, wherein:

said step of measuring a pressure parameter within each of said at least two well pipes is repeated until said internal pressure parameter stabilizes; and said step of measuring an internal pressure parameter within each of the remainder of said at least two well pipes is repeated until said internal pressure parameter stabilizes.

15. A method of locating pressure communication through a breach a nested multi-pipe production well, as recited in claim 14, wherein said connecting step further comprises the step of attaching at least two discharge pipes between said at least two well pipes and said collection reservoir, there being one discharge pipe attached between each of said at least two well pipes and said collection reservoir, the attachment being sufficient to prevent entry or exit of fluids at an attachment point of said at least two well pipes.

16. A method of locating pressure communication through a breach in a nested multi-pipe production well, as recited in claim 15, wherein said connecting step further comprises the steps of:

interposing at least two pressure valves between said at least two well pipes and said collection reservoir, said at least two pressure valves preventing pressure communication through said at least two discharge pipes when said at least two pressure valves are in a closed configuration, and said at least two pressure valves allowing pressure communication through said at least two discharge pipes when said at least two pressure valves are in an opened configuration, each pressure valve being separately configurable; and interposing at least two pressure sensors between said at least two well pipes and said at least two pressure valves, there being one of said at least two pressure sensors interposed between each of said at least two well pipes and each of said at least to pressure valves.

17. A method of locating pressure communication through a breach in a nested multi-pipe production well, as recited in claim 16, wherein said sealing step further comprises the step of preventing fluid or pressure communication between said at least two well pipes and said collection reservoir.

18. A method of locating pressure communication through a breach in a nested multi-pipe production well, as recited in claim 17, wherein said preventing step further comprises the step of closing said at least two pressure valves.

19. A method of locating pressure communication through a breach in a nested multi-pipe production well, as recited in claim 18, wherein said altering step further comprises the step of opening one of said at least two pressure valves.

20. A method of locating pressure communication through a breach a nested multi-pipe production well, as recited in claim 19, wherein said sixth step further comprises the step of closing said one of said at least two said pressure valves.

21. A method of locating pressure communication through a breach in a nested multi-pipe production well, as recited in claim 20, wherein said internal pressure parameter within each of the remainder of said at least two well pipes is the rate of change of the pressure.

22. A method of locating pressure communication through a breach in between well pipes of a nested multi-pipe production well, as recited in claim 20, wherein said internal pressure parameter within each of the remainder of said at least two well pipes is the pressure.

23. A method of locating pressure communication through a breach in between pipes of a nested multi-pipe production well, as recited in claim 22, wherein said third, fourth, fifth, and sixth steps are performed by a system controller.

24. A method of locating pressure communication through a breach in between pipes of a nested multi-pipe production well, as recited in claim 23, wherein said measuring steps are continuously performed by a system controller.

* * * * *